US007980428B2

(12) United States Patent
Beckett

(10) Patent No.: US 7,980,428 B2
(45) Date of Patent: Jul. 19, 2011

(54) VISCOUS MATERIAL DISPENSING APPARATUS WITH BRAKE

(75) Inventor: Clifford Edward Beckett, Berkshire (GB)

(73) Assignee: P.C. Cox Limited, Berkshire (GB)

( * ) Notice: Subject to any disclaimer, the term of this patent is extended or adjusted under 35 U.S.C. 154(b) by 873 days.

(21) Appl. No.: 11/844,799

(22) Filed: Aug. 24, 2007

(65) Prior Publication Data

US 2008/0047983 A1 Feb. 28, 2008

(30) Foreign Application Priority Data

Aug. 24, 2006 (GB) ..... 0616793.6

(51) Int. Cl.
*B67D 7/60* (2010.01)

(52) U.S. Cl. ..... 222/391; 74/169

(58) Field of Classification Search ..... 222/391, 222/325–327, 390; 74/141.5, 169
See application file for complete search history.

(56) References Cited

U.S. PATENT DOCUMENTS

| | | | | |
|---|---|---|---|---|
| 2,732,102 | A | 1/1956 | Ekins | |
| 4,033,484 | A * | 7/1977 | Ornsteen | 222/391 |
| 4,072,254 | A | 2/1978 | Cox | |
| 4,330,070 | A | 5/1982 | Doubleday | |
| 4,509,662 | A | 4/1985 | Weiss | |
| 4,572,406 | A | 2/1986 | Finnegan | |
| 4,572,409 | A * | 2/1986 | Finnegan | 222/391 |
| 4,681,524 | A | 7/1987 | Ikeda et al. | |
| 4,706,853 | A | 11/1987 | Stonesifer et al. | |
| 5,370,282 | A | 12/1994 | Sedlmeier | |
| 5,529,225 | A | 6/1996 | Chang | |
| 5,823,403 | A | 10/1998 | Schneider | |
| 5,887,765 | A | 3/1999 | Broesamle | |
| 6,155,463 | A | 12/2000 | Dentler | |
| 6,176,398 | B1 * | 1/2001 | Chang | 222/391 |
| 6,264,071 | B1 | 7/2001 | Dentler | |

(Continued)

FOREIGN PATENT DOCUMENTS

| | | |
|---|---|---|
| EP | 0 448 375 A2 | 9/1991 |
| EP | 1 063 019 A2 | 12/2000 |
| GB | 1 555 455 | 11/1979 |
| GB | 2 172 059 | 9/1986 |
| WO | WO 99/37407 | 7/1999 |
| WO | WO 02/083325 | 10/2002 |

OTHER PUBLICATIONS

Application and File History of U.S. Appl. No. 12/001,280, Inventor Beckett, filed Dec. 11, 2007, as available at www.uspto.gov. Four Parts of IFW. EPO Search Report and Communication as related to EPO Application No. 07254739.1, 50 pages.

*Primary Examiner* — Kevin P Shaver
*Assistant Examiner* — Jonathan Wood
(74) *Attorney, Agent, or Firm* — Patterson Thuente Christensen Pedersen, P.A.

(57) ABSTRACT

A dispensing gun for viscous material including a stock supporting a push rod which is advanceable along a keep in which a cartridge of a material can be mounted. The rod is advanced by means of a catch plate and a locking plate prevents the rod retreating with the catch plate. The locking plate is carried by the rod between a first and a second position so that it acts as a lost motion brake once force is removed from the trigger in one configuration of the dispensing gun, taking the dispensing force off the cartridge to prevent leaking when the trigger is not depressed. In an alternative configuration, the lost motion is reduced, for example to zero, to allow a continuous dispensing action by maintaining the pressure in the cartridge using a pumping action of the trigger.

16 Claims, 8 Drawing Sheets

U.S. PATENT DOCUMENTS

| | | | | |
|---|---|---|---|---|
| 6,286,718 | B1 * | 9/2001 | Durrant | 222/80 |
| 6,286,729 | B1 | 9/2001 | Lin | |
| 6,691,899 | B2 | 2/2004 | Sung | |
| 7,011,238 | B1 * | 3/2006 | Sung | 222/391 |
| 2004/0206784 | A1 | 10/2004 | Chen | |
| 2005/0006414 | A1 | 1/2005 | Tseng | |
| 2005/0023301 | A1 | 2/2005 | Runrill et al. | |
| 2008/0047983 | A1 | 2/2008 | Beckett | |
| 2008/0197155 | A1 | 8/2008 | Liang | |

* cited by examiner

VISCOUS MATERIAL DISPENSING APPARATUS WITH BRAKE

RELATED APPLICATION

The present application claims priority to GB Application No. 0616793.6 filed Aug. 24, 2006, which is incorporated herein by reference in its entirety.

FIELD OF THE INVENTION

This invention relates to a dispensing apparatus for dispensing viscous material. More particularly, although not exclusively, this invention relates to dispensing apparatus having a pressure release device to reduce the residual discharge of material.

BACKGROUND OF THE INVENTION

Viscous material, such as mastic caulking material or sealant, is commonly supplied in a plastics cartridge having a discharge nozzle. The cartridge can be mounted in a dispensing gun. An example of such a dispensing gun is described in GB Patent No. 1555455A, incorporated herein by reference. The gun has a plunger on a push rod slidably mounted in a stock. The cartridge is mounted in a keep before the plunger. The plunger is advanced by means of a gripper plate and trigger assembly to force a piston, inside one end of the cartridge, forward to urge the material from a nozzle at the other end. A brake or locking plate is also mounted on the rod. This prevents the advanced piston from retreating until a releasing force is applied to the locking plate. The trigger and gripper plate are reset at the end of a dispensing stroke, while the rod is held in position by the locking plate, and the dispensing force can then be reapplied.

By maintaining a constant force on the trigger, it is found that it is possible to exert a high degree of control over the rate of discharge of the mastic material. However, while the gun is entirely acceptable as a dispensing tool for viscous materials in most situations, it is sometimes desirable to be able to halt the discharge immediately when the hand releases the trigger.

It is found that the body of the cartridge expands radially under a dispensing force. Similarly, if any pockets of gas are trapped in the cartridge they will compress during discharge of the material and expand once the dispensing force is removed from the trigger. The contracting cartridge and any expanding pockets of gas tend to cause continued dispensing of the material when it is not required unless the locking plate is released manually.

U.S. Pat. No. 4,681,524, incorporated herein by reference, discloses a dispensing gun for the dispensing of viscous material from a cartridge in which the discharge of residual material following an application stroke is addressed by urging a locking plate to an engaging position by means of a spring to one side of the push rod. The opposite end of the locking plate is held loosely in an aperture formed in the stock. As the dispensing force is removed, the locking plate retreats within the confines of the aperture, easing the force on the rod exerted by the cartridge.

Another form of pressure release device in a dispensing gun is known from European Publication No. EP 0448315A, incorporated herein by reference, in which the locking plate is frictionally engaged with the push rod by, for example, an O ring such that it is carried by the rod between a released and an engaging relationship as the rod is respectively advanced and retreated. At the end of a dispensing stroke, the force exerted by the cartridge on the plunger results in a small retreating motion carrying the locking plate to its engaging relationship at which point further retreat of the push rod is stopped as the brake plate eventually engages. The resulting "lost motion" releases the pressure on the cartridge by backing off the rod by a small amount, bringing dispensing of the material to an abrupt halt.

SUMMARY OF THE INVENTION

The present inventor has realized that, while the above described pressure relief devices are advantageous in that they allow an exact dosing of the dispensed material without oozing, there is a mode of operation in which the oozing effect due to cartridge formation and gas trapped in the cartridge is not necessarily a drawback in all circumstances and can actually be exploited to an advantageous effect. It is found that it is possible to achieve a continuous flow of the dispensed material by priming the dispensing gun with a first trigger stroke and then maintaining the pressure on the cartridge by a repeated pumping action of the trigger such that the energy stored in the deformed cartridge, and compressed gases within it, leads to a continuous stream of dispensed material. In a dispensing gun having a pressure release device as described above this continued mode of operation is not possible.

The present invention, which is defined in independent claim 1, allows the user to choose between a non-oozing operation (pressure release on) and a continuous dispensing action (pressure release off) by providing means for reducing the lost motion of brake means such as a locking plate. Some preferred features are recited in the dependent claims.

In one embodiment, the lost motion may be reduced to substantially zero, resulting in a dispensing behavior as in conventional dispensing guns. A brake means for engaging a drive rod may be held loosely in an aperture between two contact surfaces defined by the stock of the gun and the lost motion may be reduced by inserting a spacer, such as a nub, into the aperture to reduce the play of the brake means within it, thereby reducing the lost motion of the brake means. When the spacer and the brake means together substantially fill the aperture, a conventional dispensing behavior is obtained. The spacer may be formed with an arcuate nub on a side thereof which advantageously engages the corresponding surface of the aperture to provide a smooth pivoting action of the locking plate.

The brake means may be a locking plate but other forms of frictional engagement are possible, such as an elastomeric member arranged in relation to the drive rod to provide essentially one-way motion until manually released. The lost motion reducing or adjusting means may be provided on a sleeve sliding up and down the plate between first and second positions in which the spacer is respectively inserted and removed from the gap. The sleeve may be held in the first and second positions by a shaped aperture around the rod defining a detent. The plate may be biased into an engaged relationship with the rod by a resilient biasing means such as a spring providing a resilient urging force on a side of the push rod such that the brake means are carried by the rod to the first and second positions.

The brake means may be frictionally engaged with the rod such that it is carried between the advanced and retreated positions by virtue of movement of the rod itself.

The adjusting means for varying or eliminating the amount by which the rod can be retreated can be mounted on the break means in some embodiments. For example they can be slidable on the break means between different positions between pressure release being fully on and off. In some embodiments the adjusting means can comprise a member which is movable onto and out of a gap defining the play in the brake means which defines the lost motion, thereby to vary the lost motion.

BRIEF DESCRIPTION OF THE DRAWINGS

The present invention can be put into practice in various ways, one of which will now be described by way of example with reference to the accompanying drawings in which.

DETAILED DESCRIPTION OF THE DRAWINGS

Commonly used cartridges have a generally cylindrical body containing viscous material such as a caulking mastic. The cylindrical body is open at one end and contains a cup-shaped piston which is slidable along the length of the body. The opposite end of the cartridge is constricted to form a shoulder leading to a nozzle.

Figure 1:
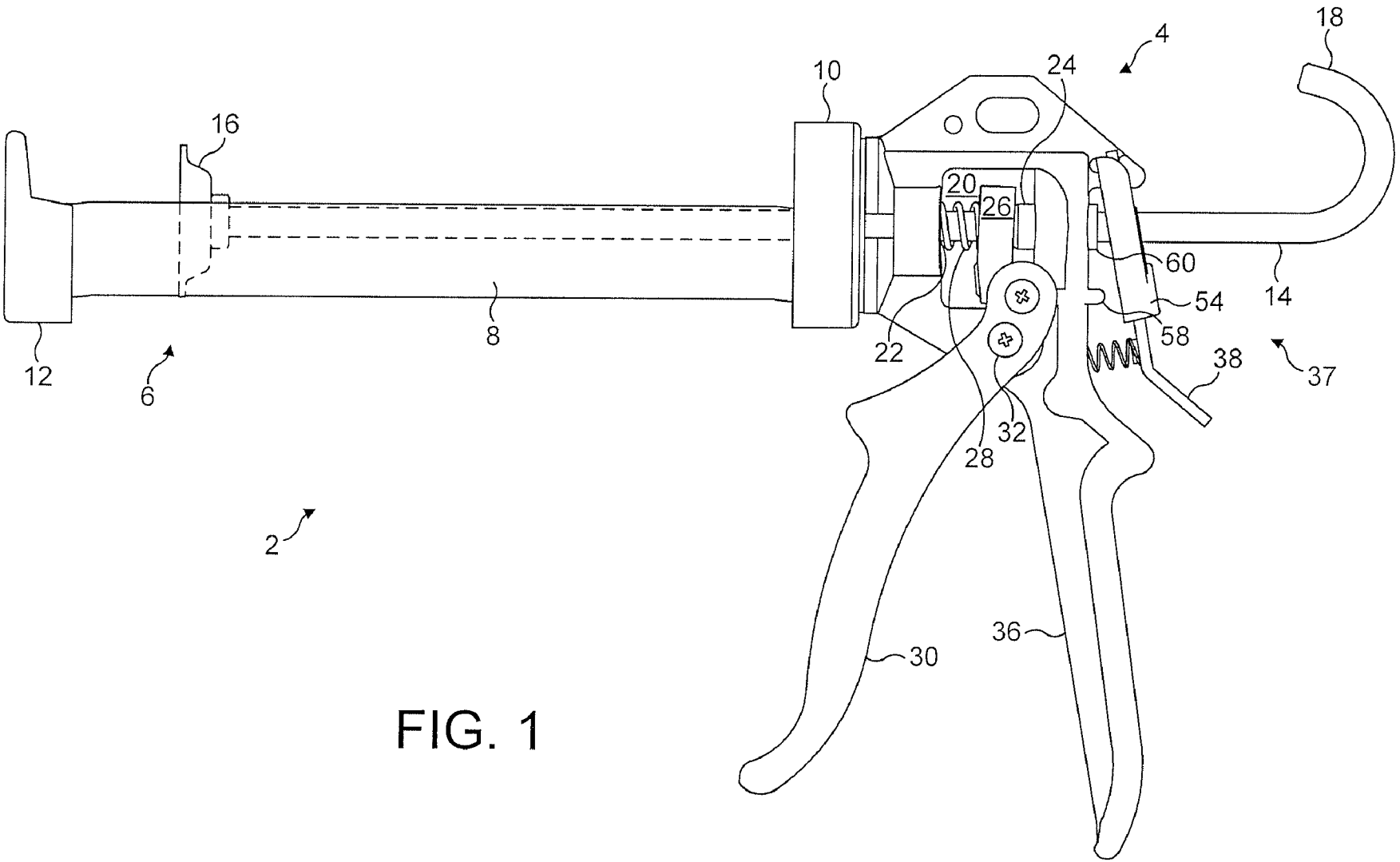
FIG. 1 shows a side elevation of a dispensing gun according to an embodiment of the invention.

With reference to FIG. 1, apparatus 2 for dispensing material from such a cartridge comprises a stock 4 and a cartridge keep 6. The keep 6 comprises two elongate parallel side frame members 8. One end of each member 8 merges with a generally cup shaped rest 10 secured to the stock 4. The opposite ends of the side frame 8 members are connected to an annular generally cup-shaped yoke member 12 having a large opening at its base.

A push rod 14 is mounted in the stock 4 for longitudinal movement in a direction parallel to and midway between the two side frame members 8. At one end of the rod 14 there is a plunger 16 which engages the piston of the cartridge. The other end of the rod 14 is formed as a hook 18 by which the gun may be suspended when it is not in use and which acts as a handle by which the rod 14 may be moved longitudinally.

The rest 10 bridges the members 8 in front of the stock 4. The rest 10 cooperates with the cup shaped yoke member 12 to form a cradle to hold the cartridge in position before the push rod 14 is advanced to engage the piston.

The stock 4 is formed with a large central transverse aperture 20. On either side of the aperture there are guide holes 22 and 24 which carry the rod 14, extending into the keep 6.

The rod can be moved incrementally by a mechanism comprising a catch plate 26 in the aperture 20, having an opening through which the rod 14 extends as a clearance fit.

The catch plate 26 is pivotably held between flanks on a trigger 30 and is biased rearwards into an engaged attitude with the rod 14 by a spring 28. The rod 14 can be advanced by means of the trigger 30 pivoting about a point in the stock 4 defined by a rivet 32. The stock 4 has an integral butt portion 36 which extends downwardly and generally perpendicularly to the axis of the rod 14. When the trigger 30 is squeezed, the butt portion 36 lies generally within the hollow of the shaped trigger.

Figure 2A:
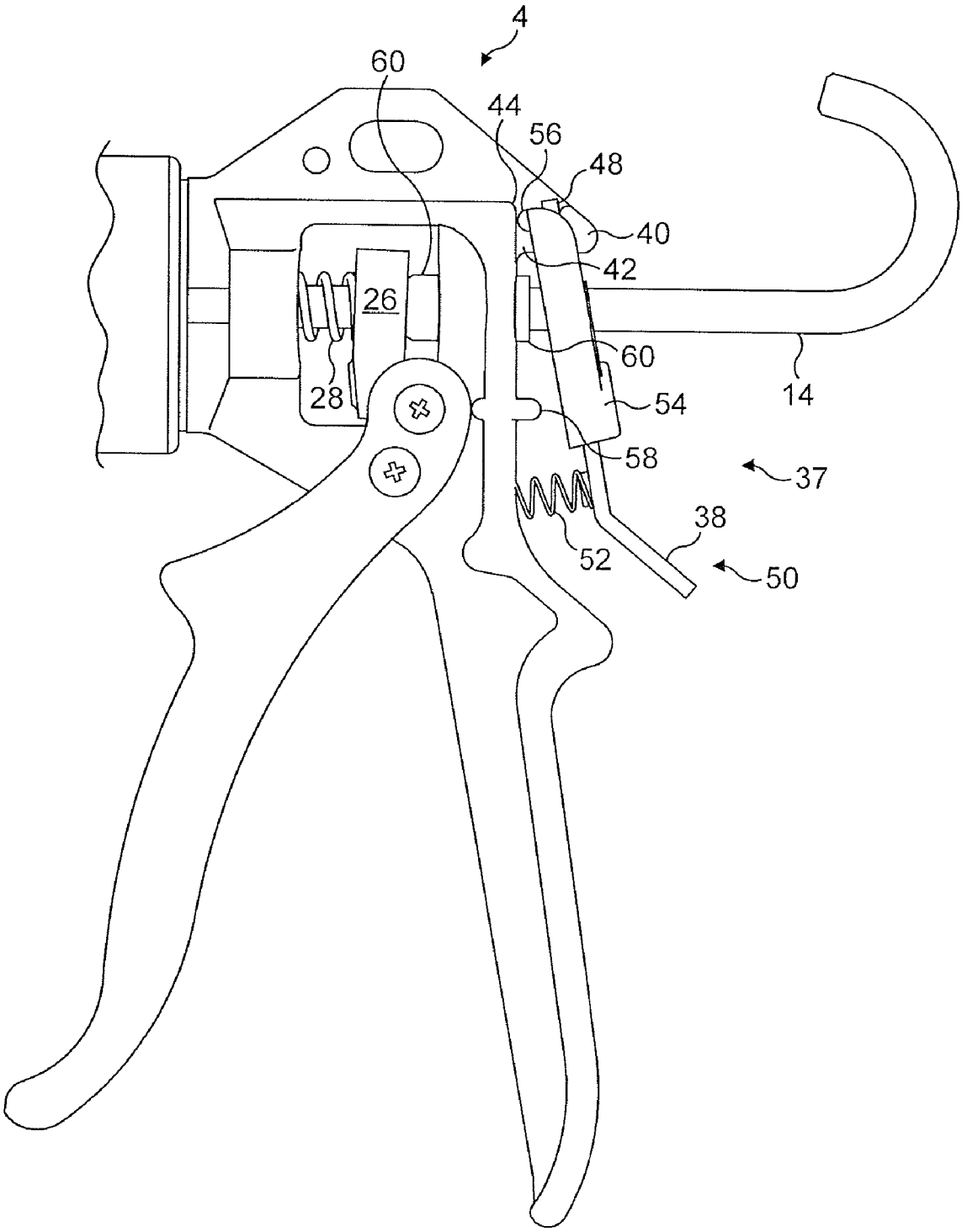
FIGS. 2*a* and 2*b* respectively show a side elevation and a perspective view of the stock portion in a configuration with pressure relief being disabled.
Figure 2B:
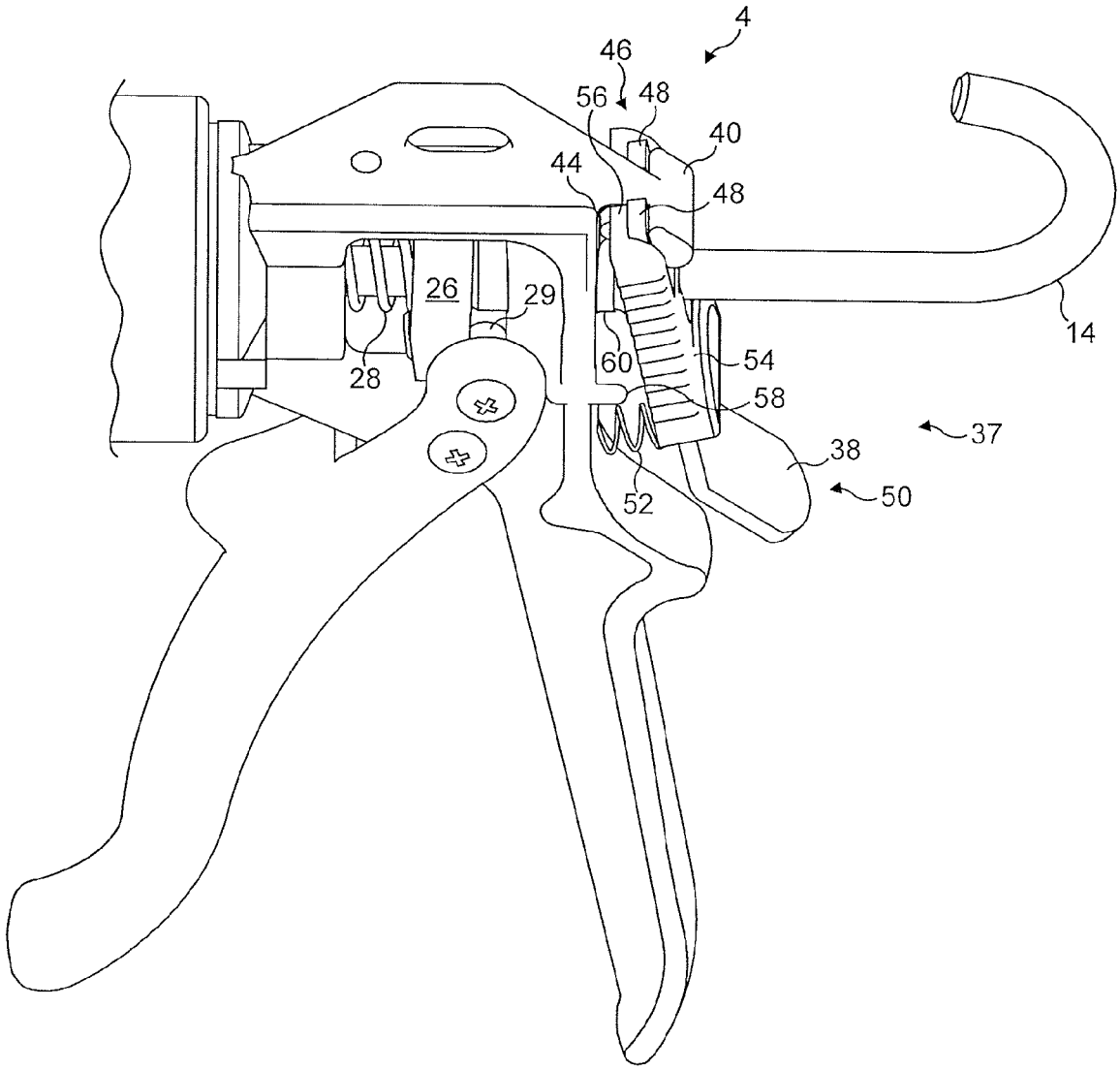
Figure 3:
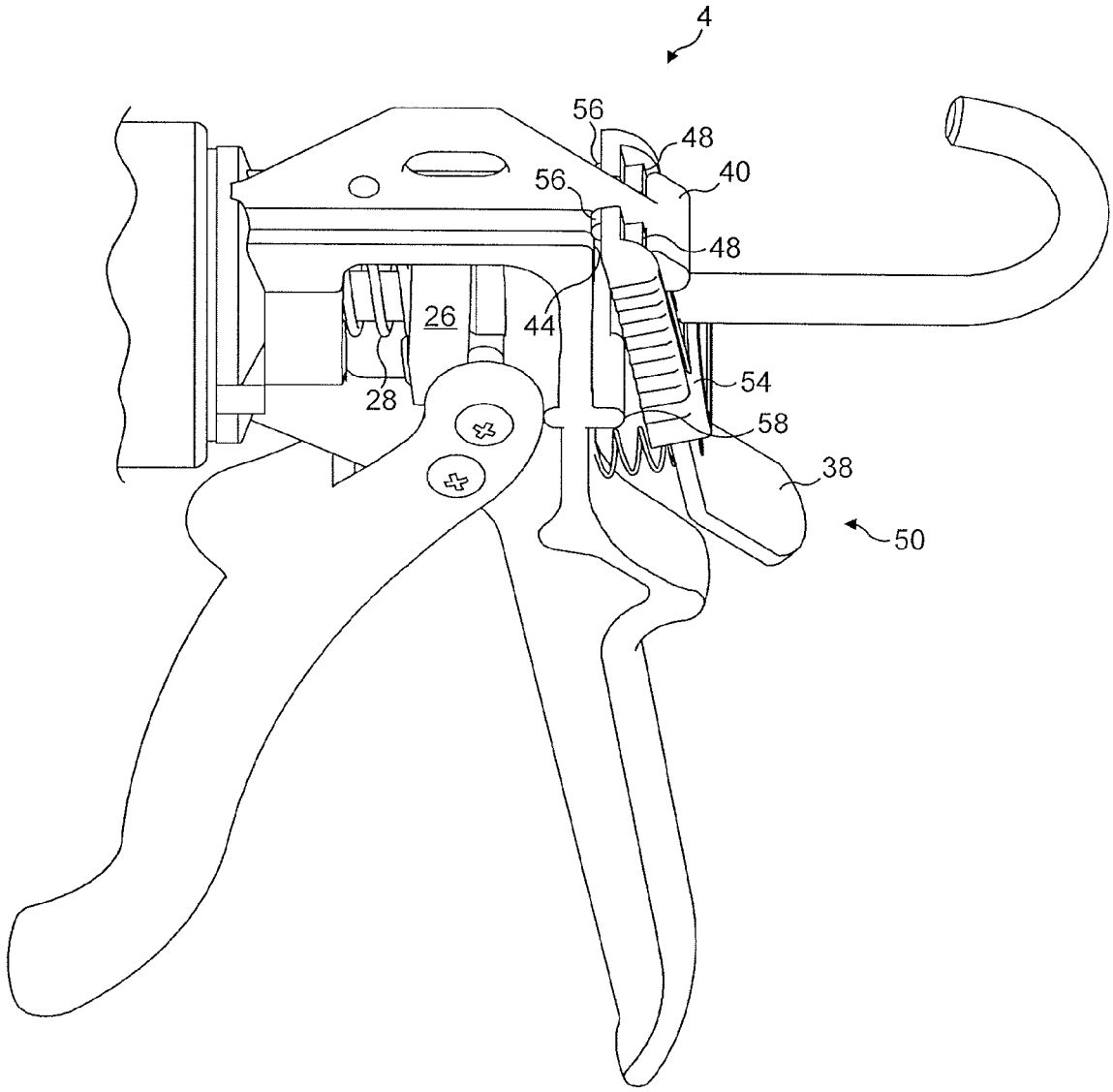
FIG. 3 shows a perspective view of the stock portion in a configuration with pressure release enabled.

With reference also to FIGS. 2*a*, 2*b*, and 3, a brake assembly 37 is also mounted on the rod so that retreat of the rod can be arrested once the trigger is no longer applying an advancing force. The brake assembly 37 comprises a locking plate 38 which defines a clearance hole through which the rod 14 extends. The plate 38 has an upper slot formed by tongues 48, in its upper surface which is received about a rearwardly extending flange 42 on the stock 4. The plate 38 is loosely held in this position by a pair of transverse abutments 40 behind a shoulder 44 in front of the plate 38.

The slot is arranged such that each of the tongues 48 is disposed on a respective side of the flange 42. The tongues 48, in co-operation with the rod 14, determine the lateral and vertical position of the locking plate 38.

At a lower end 50 of the locking plate 38, below the rod 14, a compression spring 52 is disposed between the locking plate 38 and the stock 4. The spring 50 biases the locking plate 38 into an engaged attitude with the rod 14 such that the rod 14 can advance but not retreat, as described in more detail below.

A sleeve 54 is arranged on the locking plate 38 so that it can be slid along it. At its upper end, the sleeve 54 has nubs 56 which are generally opposite respective tongues 48 of the locking plate 38. When the sleeve 54 is in a lower position, the nubs 56 are positioned in the gap between the shoulder 44 and the abutments 40 such that there is substantially no play of the tongues 48, as shown in FIGS. 2*a* and 2*b*. Each nub 56 has an arcuate forward facing protrusion to allow for a smooth rocking action of the locking plate 38 with respect to the shoulder 44. When the sleeve 54 is in a raised position, as shown in FIG. 3, the nubs 56 are removed from between the shoulder 44 and respective abutments 40. The tongues 48 are loosely held in the gaps such that there is play between the shoulder 44 and the abutments 40. The sleeve 54 can thus be disposed in relation to the locking plate 38 in a raised position, as shown in FIG. 3, in which the locking plate 38 can move between a first and a second position and in a downward position as shown in FIGS. 2*a* and 2*b*, where this movement is substantially eliminated, as described below.

The keep 6, the stock 4, and the butt portion 36 may be formed as a unitary item from glass filled nylon. The trigger 30 may be made of the same material. Alternatively, the mastic gun 2 could be made substantially of cast or stamped metal parts as described, for example, in GB Patent No. 1555455. Any other suitable rigid material can be used for three parts or a combination thereof.

Figure 4A:
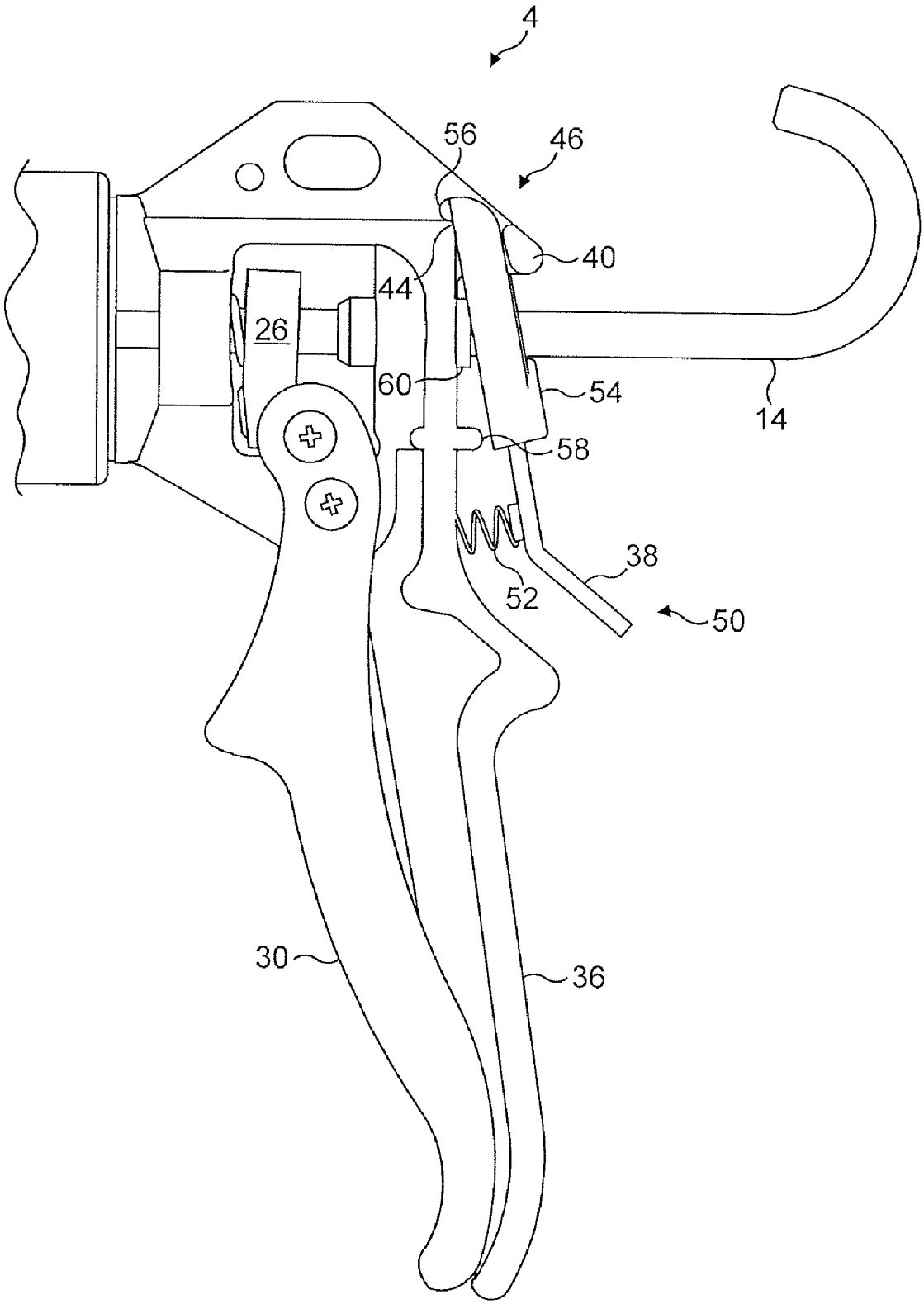
FIGS. 4*a* and 4*b* respectively show a side elevation of the stock portion, with pressure release enabled, at the end of a trigger stroke and as the trigger is being released.
Figure 4B:
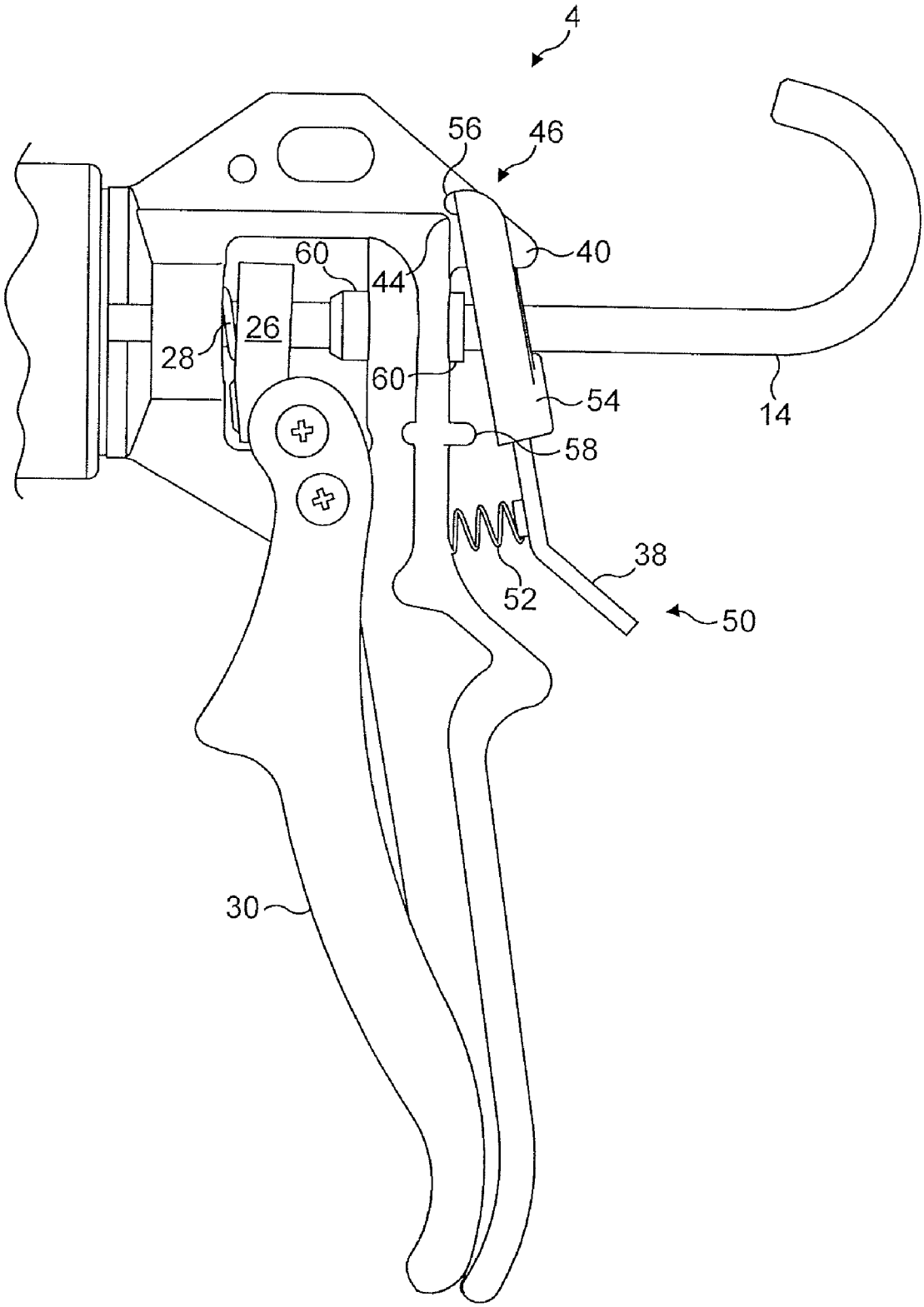

With reference to FIGS. 4*a* and 4*b*, as the trigger 30 is squeezed against the butt 36, the catch plate 26 is already in an engaged attitude and therefore, advances the rod 14. As the rod 14 advances, it carries with it the locking plate 38 which is maintained in an engaged relationship with the rod 14 by spring 52. When the sleeve 54 is in an upper position as shown in FIGS. 4*a* and 4*b*, the locking plate 38 moves forward with the advancing rod 14 until it strikes the shoulder 44, the nub 56 clearing the shoulder 44 at the top. At this point further linear forward movement of the locking plate 38 is blocked, and as the rod 14 advances further, it gives slightly about shoulder 44 against spring 52 into a yielded altitude such that the rod 14 is free to advance. As the rod 14 advances, the locking plate 38 is maintained in its yielded attitude by the action of the friction between the locking plate 38 and the rod 14 against the biasing force at the spring 52. FIG. 4*a* shows the gun 2 with the trigger 30 in its position at the end of a stroke.

FIG. 4*b* shows the gun 2 in a position just after the trigger 30 has been released. As soon as the advancing force on the rod 14 is removed, the biasing force of spring 52 is no longer balanced by a frictional force and the locking plate 38 is urged back into an engaged attitude with the rod 14. As the trigger 30 is released the spring 28 acts on the catch plate 26 to urge it backward to the rest position as shown in FIG. 2*a*.

As the rod 14 travels backwards, the locking plate 38, now again engaged with the rod 14 by action of the biasing force of the spring 52, travels backwards with the retreating rod 14 until it strikes the abutment 40, at which point further retreat of the rod 14 is prevented as the edges defining the aperture in the locking plate bite on the rod 14. At the end of each stroke, the rod 14 thus retreats by an amount of lost motion or retreat due to the play of the sleeve 54 between the shoulders 44 and abutment 40. In other words, the lost motion results from rod 14 being released from the locking plate 38 as the latter strikes the shoulder 44 but being blocked from retreating as the locking plate 38 strikes the abutment 40. Due to this lost motion, the rod 14 and plunger 16 back off the piston of the cartridge at the end of each stroke, thereby reducing the pressure in the cartridge and bringing the dispensing flow at the cartridge material to an abrupt halt.

In an alternative configuration with the sleeve 54 in the lower position as depicted in FIGS. 2*a* and 2*b*, the nubs 56, together with the tongues 46 of the locking plate 38 fill the gap between the shoulder 44 and the abutment 40. In this configuration, release of the locking plate 38 as the rod 14 moves forward and the prevention of the rod's 14 retreat by the engaged locking plate 38 engaging the abutment 40 occur at substantially the same longitudinal position of the plate 38 as there is no play of the locking plate 38 between the abutments 40 and the shoulder 44 and the locking plate 38 substantially immediately bites on the rod 14 after only minimal movement. The lost motion is thus reduced to substantially zero and pressure is maintained in the cartridge as the trigger 30 is released.

In order to release the rod 14, for example to retreat it to allow a change of cartridge, the locking plate 38 can be depressed manually (at its lower end 48) against the spring 52, whereby a stop 58 and the abutment 40 hold the locking plate 38 in a defined upright released attitude with respect to the rod 14. Since the spring 28 maintains the catch plate 26 in an engaged attitude a sleeve 60 is arranged around the rod 14 where it passes through the through hole 24. The length of the sleeve 60 is selected such that, when the locking plate 38 is manually fully depressed it pushes the sleeve 60 against the catch plate 26 to urge into an upright released position with respect to the rod 14 such that the latter can move freely with respect to both the catch plate 26 and the locking plate 38.

With reference to FIGS. 5*a* to 5*d*, the sleeve 54 is now described in more detail. As described above, the nubs 56 include a radiused or arcuate surface which provides a surface for a smooth rocking action against the shoulder 44. The locking plate 38 is accepted in a slot 62 in the sleeve 54, and the rod 14 passes through an aperture 64 in the sleeve 54.

The aperture 64 is shaped such that the sleeve 54 is moveable by a user and maintained in one of the upper and lower positions. It defines a first and a second part circular portion 66, 68 of a radius sufficiently large to loosely accept the rod 14. These are joined by a waist section 72. Adjacent the aperture 64 are slots 74 which allow the aperture 64 to deform as the sleeve 54 slides over the rod 14. The slots 74 and the dimensions of the waist 72 are arranged such that the aperture 64 can be deformed sufficiently easily to allow a user to slide the sleeve 54 between the two detent positions defined by the two part circular portions 66, 68.

Figure 5A:
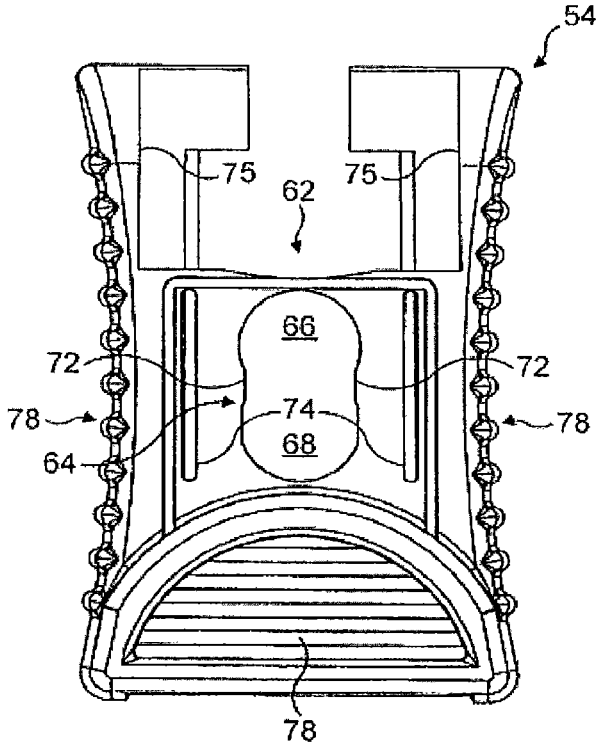
FIGS. 5*a* to 5*d* respectively show a top, side, lower and front elevation of a sleeve for mounting on a locking plate of the dispensing gun.
Figure 5B:
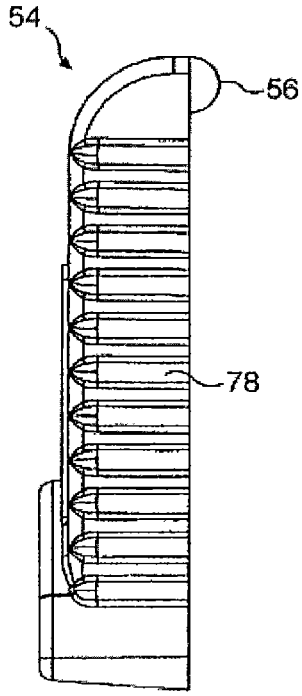
Figure 5C:
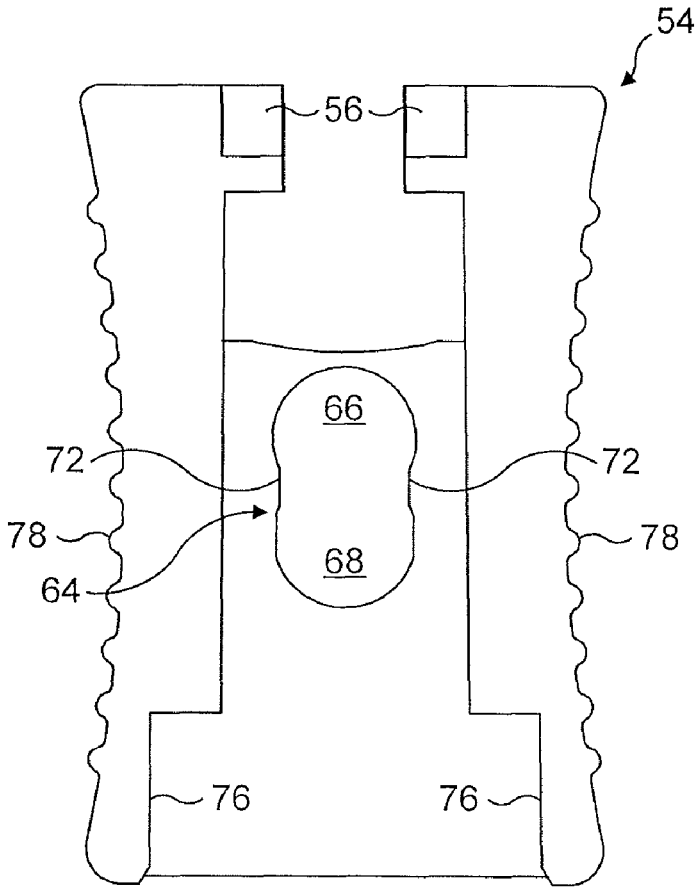
Figure 5D:
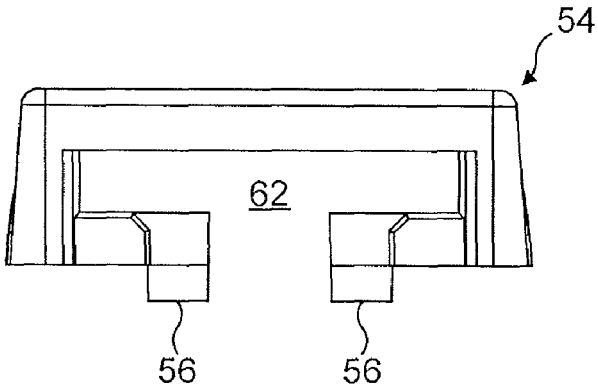

When viewed from the top in FIG. 5*a*, the surface of the sleeve 54 facing away from stock 4 is resected at its upper and 75 which ensures that the abutment 40 is in direct contact with the locking plate 38. Similarly, when viewed from the bottom in FIG. 5*c*, the surface of the sleeve 54 facing the stock is resected at its lower end 76, allowing stop 58 to directly contact the locking plate 38. The sleeve 54 includes ribbed surfaces 78 on its sides and lower top surface to provide a secure grip for a user manipulating the sleeve 54 with a thumb, finger or a combination of them.

It will be understood that the above description is of one particular embodiment of the invention and that many modifications and changes to the described embodiment would be apparent to the skilled person. For example, the nub which is inserted to reduce the play of the locking plate within a gap defined by the stock could be dimensioned to only partially occupying the gap left by the locking plate in the aperture, thereby reducing but not substantially eliminating the lost motion or retreat, and hence providing for adjusting or varying, rather than eliminating, the retreat or lost motion of the rod.

As a further alternative the nub described could be replaced by a surface that gradually filled the gap where the play is affected according to the extent of movement of the sleeve or other means by which the gap is occupied. For example the nub could be replaced by a ramp surface that is inclined to increase in thickness towards the top of the locking plate so that the play is variable according to the point on the ramp about which the plate is able to rock.

The spacer could be mounted otherwise than on a sleeve secured to the locking plate, for example it could be mounted on a member pivotably or slidably secured to the stock itself, as long as it is arranged to removably introduce a spacer in to the gap to vary the lost motion referred to above.

Finally, other mechanisms for moving the locking plate from an engaged to a released attitude towards the rod, and visa versa, for example as described in EP-A-0448315, are also variants that could be used.

It will thus be understood that the above specific description is explanatory only and that the invention is defined by the scope of the appended claims.

The invention claimed is:

1. A dispensing apparatus for dispensing viscous material, the dispensing apparatus comprising:
   - a stock;
   - holding means for holding an amount of the material, the holding means projecting from the stock;
   - a push rod longitudinally moveably mounted in the stock and positioned to extend generally in the direction in which the holding means projects;
   - engaging means for engaging the rod to advance the rod;
   - brake means for holding the rod such that the rod is moveable in a direction advancing the rod into the holding means and the rod is held in a direction retreating the rod from the holding means, wherein the brake means are shiftable between a first position relative to the stock as the rod advances and a second position as the rod retreats thereby defining a retreat of the rod; and
   - adjusting means arranged in relation to the stock to be operable to vary the retreat of the rod, wherein the adjusting means includes an elongated aperture by which the rod is embraced, the shape of the aperture including detents defining positions of the adjusting means each corresponding to different amounts of retreat of the rod.

2. The dispensing apparatus of claim 1, wherein the adjusting means are mounted on the brake means.

3. The dispensing apparatus of claim 2, wherein the adjusting means are slidable relative to the brake means to vary the retreat of the rod.

4. The dispensing apparatus of claim 1, wherein the adjusting means cooperate with a part of the stock that defines a region of movement for the brake means as the brake means shift between the first and second positions, the adjusting means comprising a member movable into the said region to reduce the retreat of the rod.

5. The dispensing apparatus of claim 4, wherein the member is a nub moveable substantially to fill the region of movement for the brake means.

6. The dispensing apparatus of claim 5, wherein the nub has an arcuate surface for engaging the stock.

7. The dispensing apparatus of claim 1, wherein the brake means are biased into a braking relationship with the rod.

8. The dispensing apparatus of claim 1, wherein the brake means are frictionally engaged with the rod so that the brake means is carried between the first and second positions as the rod is advanced or retreated.

9. The dispensing apparatus of claim 1, wherein the brake means include a locking plate.

10. A dispensing apparatus for dispensing viscous material, the dispensing apparatus comprising:

a stock;

a cartridge holder operably connected to the stock and projecting from the stock;

a push rod longitudinally moveably mounted in the stock and positioned to extend generally in the direction in which the cartridge holder projects;

a clutch member for engaging the rod to advance the rod;

a brake assembly adapted to hold the rod such that the rod is moveable in a direction advancing the rod into the cartridge holder and the rod is held in a direction retreating the rod from the cartridge holder, wherein the brake assembly is shiftable between a first position relative to the stock as the rod advances and a second position as the rod retreats thereby defining a retreat of the rod; and an adjusting assembly arranged in relation to the stock to be operable to vary the retreat of the rod, wherein the adjusting assembly includes a sleeve having an elongated aperture which embraces the rod, the shape of the aperture including detents defining positions of the adjusting assembly, each corresponding to different amounts of retreat of the rod.

11. The dispensing apparatus of claim 10, wherein the adjusting assembly comprises a sleeve slidably mounted on the brake assembly to vary the retreat of the rod.

12. The dispensing apparatus of claim 10, wherein the adjusting assembly cooperates with a part of the stock that defines a region of movement for the brake assembly as the brake assembly shifts between the first and second positions, the adjusting assembly comprising a member movable into the region of movement to reduce the retreat of the rod.

13. The dispensing apparatus of claim 12, wherein the member comprises a nub substantially moveable to fill the region of movement for the brake assembly, and wherein the nub has an arcuate surface for engaging the stock.

14. The dispensing apparatus of claim 10, wherein the brake assembly frictionally engages the rod so that the brake assembly is carried between the first and second positions as the rod is advanced or retreated.

15. The dispensing apparatus of claim 10, wherein the dispensing apparatus further comprises a trigger operably connected to the clutch member.

16. The dispensing apparatus of claim 10, wherein the brake assembly includes a locking plate and a compression spring positioned between the locking plate and the stock.

* * * * *

UNITED STATES PATENT AND TRADEMARK OFFICE

CERTIFICATE OF CORRECTION

PATENT NO. : 7,980,428 B2
APPLICATION NO. : 11/844799
DATED : July 19, 2011
INVENTOR(S) : Beckett It is certified that error appears in the above-identified patent and that said Letters Patent is hereby corrected as shown below:

On the Title Page Item 56:
Under "U.S. PATENT DOCUMENTS" delete "4,572,406 A 2/1986 Finnegan".

Column 2, Lines 64 and 66:
Delete "break" and insert -- brake --.

Column 4, Line 56:
Delete "altitude" and insert -- attitude --.

Column 5, Line 64:
Delete "and" and insert -- end --.

Signed and Sealed this
Twentieth Day of December, 2011

David J. Kappos

David J. Kappos
*Director of the United States Patent and Trademark Office*